US008615186B2

(12) United States Patent
Kikuchi et al.

(10) Patent No.: US 8,615,186 B2
(45) Date of Patent: Dec. 24, 2013

(54) DEVELOPMENT DEVICE AND IMAGE FORMING APPARATUS INCORPORATING SAME

(75) Inventors: Hiroshi Kikuchi, Kanagawa (JP); Yasuo Takuma, Kanagawa (JP); Junichi Matsumoto, Kanagawa (JP); Tomoya Ohmura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 150 days.

(21) Appl. No.: 13/401,297

(22) Filed: Feb. 21, 2012

(65) Prior Publication Data

US 2012/0230733 A1 Sep. 13, 2012

(30) Foreign Application Priority Data

Mar. 10, 2011 (JP) ..... 2011-052974

(51) Int. Cl.
*G03G 15/08* (2006.01)

(52) U.S. Cl.
USPC ..... 399/254; 399/255; 399/256; 399/257

(58) Field of Classification Search
USPC ..... 399/254, 255, 256, 257
See application file for complete search history.

(56) References Cited

U.S. PATENT DOCUMENTS

| | | | | |
|---|---|---|---|---|
| 7,257,354 | B2 * | 8/2007 | Schlageter et al. | 399/257 |
| 7,376,374 | B2 * | 5/2008 | Adachi | 399/254 |
| 7,917,055 | B2 | 3/2011 | Katsuyama et al. | |
| 8,000,638 | B2 | 8/2011 | Ohmura et al. | |
| 8,073,368 | B2 | 12/2011 | Iwata et al. | |
| 8,112,016 | B2 * | 2/2012 | Matsumoto et al. | 399/254 |
| 2009/0123174 | A1 | 5/2009 | Iwata et al. | |
| 2009/0185832 | A1 | 7/2009 | Muramatsu et al. | |
| 2010/0124443 | A1 | 5/2010 | Ohmura et al. | |
| 2010/0143000 | A1 | 6/2010 | Matsue et al. | |
| 2010/0290815 | A1 | 11/2010 | Ichikawa et al. | |
| 2011/0044726 | A1 | 2/2011 | Katoh et al. | |
| 2011/0182610 | A1 | 7/2011 | Ohmura et al. | |
| 2011/0229207 | A1 | 9/2011 | Matsumoto et al. | |
| 2011/0268478 | A1 | 11/2011 | Ohmura et al. | |

FOREIGN PATENT DOCUMENTS

| | | |
|---|---|---|
| JP | 8-22190 | 1/1996 |
| JP | 2007-334288 | 12/2007 |
| JP | 2008-299196 | 12/2008 |
| JP | 2009-204630 | 9/2009 |

* cited by examiner

*Primary Examiner* — David Gray
*Assistant Examiner* — Michael Harrison
(74) *Attorney, Agent, or Firm* — Oblon, Spivak, McClelland, Maier & Neustadt, L.L.P.

(57) ABSTRACT

A development device includes a development portion to develop a latent image; an agitation container to contain developer; a circulation system through which the developer is circulated between the development portion and the agitation container; a developer replenishing device to supply fresh developer to the agitation container; an agitator, provided inside the agitation container, to agitate and mix the developer collected from the development portion and the fresh developer from the developer replenishing device; and a developer escape chamber to discharge surplus developer in the agitation container, projecting from and continuous with the agitation container, the developer escape chamber defining a communication pathway in a side of the agitation container between the agitation container and the developer escape chamber through which the developer is moved between the agitation container and the developer escape chamber and having a discharge opening whose lower end is positioned higher than the communication pathway.

6 Claims, 5 Drawing Sheets

DEVELOPMENT DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-052974, filed on Mar. 10, 2011 in the Japan Patent Office, the entire disclosure of which is hereby incorporated by reference herein.

BACKGROUND

1. Technical Field

The present invention related to a development device and an image forming apparatus, such as a copier, a facsimile, and a printer, incorporating the development device, and more particularly, to a development device using two-component developer including magnetic carrier and toner.

2. Description of the related art

In known development devices using two-component developer, fresh developer is supplied to the development device in order to maintain a certain toner concentration while the added developer is discharged from the development device. In this type of development device, old magnetic carrier of the developer can be replaced with fresh carrier little by little by such continuous supply and discharge of the developer. Accordingly, deterioration of the magnetic carrier in the development device is retarded, which can decrease the frequency with which the developer must be replaced.

As the development device to which the developer is supplied and from which the developer is discharged, typically a suitable amount of the developer is retained by forming a discharge opening within a screw transport path positioned close to a developer bearer in the development device, where the condition of the level of the developer is relatively stable and the height of the level of the developer fluctuates in accordance with the increase and decrease in the amount of the developer (as, for example, in JP-H08-022190-A).

By contrast, there are development devices in which an agitation container to agitate the developer is provided separately from the part of the device that actually develops the image (a "development portion"). The developer that has been sufficiently agitated in the agitation container is circulated between the agitation container and the development portion. This system has the advantage that, since the agitation container is separated from the development portion, the development portion can be minimized, thus making good use of the limited space near a photoreceptor (image carrier). In addition, the developer is agitated in accordance with the condition of the developer, and therefore, developer of a toner concentration and charging amount adjusted suitably in the agitation container can be supplied to the development portion. However, a drawback of this system is that, when the amount of developer conveyed from the agitation container to the development portion fluctuates, the amount of the developer in the development portion fluctuates, which may easily adversely affect the development process. Accordingly, a known way to convey a constant amount of the developer from the agitation container to the development portion is a pneumatic system, such as an air pump.

In development devices through which the developer is circulated between the agitation container and the development portion, it is desirable that, when the developer is supplied and discharged, the supplied fresh developer is agitated and mixed with the used developer conveyed from the development portion and then the mixed developer in the agitation container is conveyed to the development portion. However, with a constant amount of the developer being conveyed from the agitation container to the development portion, the amount of the developer in the development portion does not change even as the amount of the developer in the agitation container increases with the supply of fresh developer. In addition, the increase in the amount of developer in the agitation container may cause the developer to overflow.

SUMMARY

In one aspect of this disclosure, there is provided a development device including a development portion, a developer agitation container, a circulation system, a developer replenishing device, an agitator, and a developer escape chamber. The development portion, develops a latent image formed on a latent image carrier with developer including toner and carrier particles. The developer agitation container that is positioned separately from the development portion contains the developer. The developer is circulated between the development portion and the developer agitation container through the circulation system. The developer replenishing device supplies fresh developer to the developer agitation container. The agitator, provided inside the developer agitation container, agitates and mixes the collected developer collected from the development portion through the circulation system and the fresh developer from the developer replenishing device. The developer escape chamber discharges surplus developer in the developer agitation container, projecting from and continuous with the developer agitation container. The developer escape portion defines a communication pathway in a side of the developer agitation container between the developer agitation container and the developer escape chamber through which the developer is moved between the developer agitation container and the developer escape chamber. The developer escape portion has a discharge opening whose lower end is positioned higher than the communication pathway.

In another aspect of this disclosure, there is provided an image forming apparatus including a latent image carrier to carry a latent image; and the above-described development device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
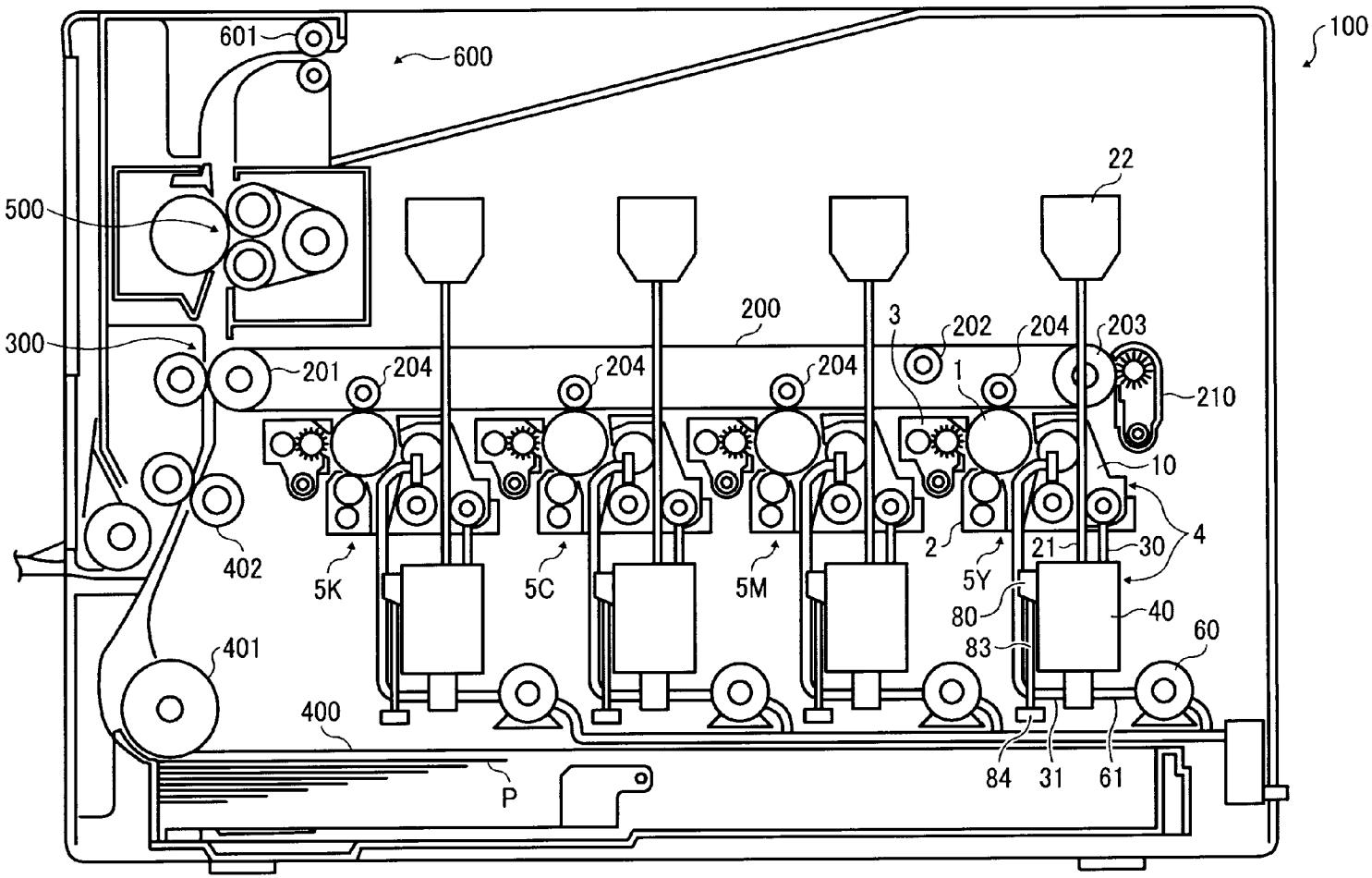
FIG. 1 is a schematic diagram illustrating an image forming apparatus according to embodiments of the present disclosure.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIGS. 1 through 7B, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

Entire Configuration of Image Forming Apparatus

FIG. 1 is a schematic diagram illustrating an entire configuration of a color image forming apparatus 100 including a development device of the present embodiment. A configuration and operation of the present embodiment is described below.

The image forming apparatus 100 in FIG. 1 includes four image forming units 5Y, 5M, 5C, and 5K for respectively forming yellow, magenta, cyan, and black, (hereinafter also simply "Y, M, C, and K") single-color toner images disposed facing a lower surface of an intermediate transfer belt 200.

It is to be noted that, in this specification, reference character suffixes Y, M, C, and K attached to an identical reference numeral indicate only that components indicated thereby are used for forming different single-color images, respectively, and hereinafter may be omitted when color discrimination is not necessary. Using the image forming unit 5Y as an example, the configurations of the image forming units 5M, 5C, and 5K are described below.

As shown in FIG. 1, the image forming unit 5Y includes a photoreceptor drum 1, serving as a latent image carrier, a charger 2, a development portion 10, and a cleaning device 3. In the image forming unit 5Y, the photoreceptor drum 1 is rotated by a driving mechanism, not shown, and, a surface of the photoreceptor drum 1 is uniformly charged in a portion facing the charger 2. When the surface of the photoreceptor drum 1 reaches a portion receiving a laser beam emitted from a light writing unit, not shown, the laser beam scans the surface of the photoreceptor drum 1, thus forming a latent image on the portion receiving the laser beam in accordance with image formation. Then, the latent image formed on the surface of the photoreceptor 1 reaches a portion facing the development portion 10, and the latent image thereon is developed into a toner image with the toner included in developer supplied from the development portion 10.

Inside the intermediate transfer belt 200, four primary transfer members 204, a secondary transfer support roller 201, a belt tension roller 202, a belt-cleaning support roller 203 are provided. A belt-cleaning device 210 that cleans the intermediate transfer belt 200 is disposed facing the intermediate transfer belt 200 and the belt-cleaning support roller 203.

When the respective surfaces of the photoreceptor drums 1Y, 1M, 1C, and 1K that carry the toner images reach the portions facing the intermediate transfer belt 200 and primary transfer members 204Y, 204M, 204C, and 204K, toner images formed on the respective photoreceptor drums 1Y, 1M, 1C, and 1K are primarily transferred from the photoreceptor drums 1Y, 1M, 1C, and 1K and superimposed one on another on the surface of the intermediate transfer belt 200. Thus, a multicolor (four-color) image is formed on the intermediate transfer belt 200.

After the primary transfer process, the toner image formed on the surface of the photoreceptor drum 1 reaches a portion facing the cleaning device 3, where un-transferred toner that remains on the surface of the photoreceptor drum 1 is collected by the cleaning device 3.

A secondary transfer member 300 is disposed facing and pressing against the secondary transfer support roller 201 in the intermediate transfer belt 200, forming a secondary transfer nip therebetween. When the four-color toner image formed on the surface of the intermediate transfer belt 200 reaches the secondary transfer nip, the four-color toner image is transferred onto a transfer sheet P, at one time.

Along with these processes, the transfer sheet P is fed one-by-one by a feed roller 401 from a feeding cassette 400 that is disposed in a lower portion of the image forming apparatus 100 and contains multiple transfer sheets P.

Then, the transfer sheet P thus fed is stopped by a pair of registration rollers 402, and then skews of the transfer sheet P is corrected, after which the pair of the registration rollers 402 transports the transfer sheet P toward the second transfer nip, timed to coincide with the formation of the toner image. Thus, the desired multicolor toner image is transferred onto the transfer sheet P at the second transfer nip.

The transfer-sheet P onto which the multicolor image is transferred at the second transfer nip is transported to a fixing device 500 positioned above the secondary transfer member 300 in FIG. 1, where the four-color toner image thus transferred is fixed on the surface of the transfer sheet P with heat and pressure.

After that, the transfer sheets P are discharged toward a discharge sheet portion 600 located on an upper portion of the image forming apparatus 100 via a pair of discharging sheet rollers 601 and are stacked on the discharge sheet portion 600. Thus, a series of the image forming process completes.

Hereinafter, a system including all items to perform the development process including the development portion 10 and a developer agitation unit 40 formed by a agitation container 41 is called as a development device 4. As shown in FIG. 1, each of the development devices 4 further includes a supplemental developer hopper 22.

Configuration of Development Device

Figure 2:
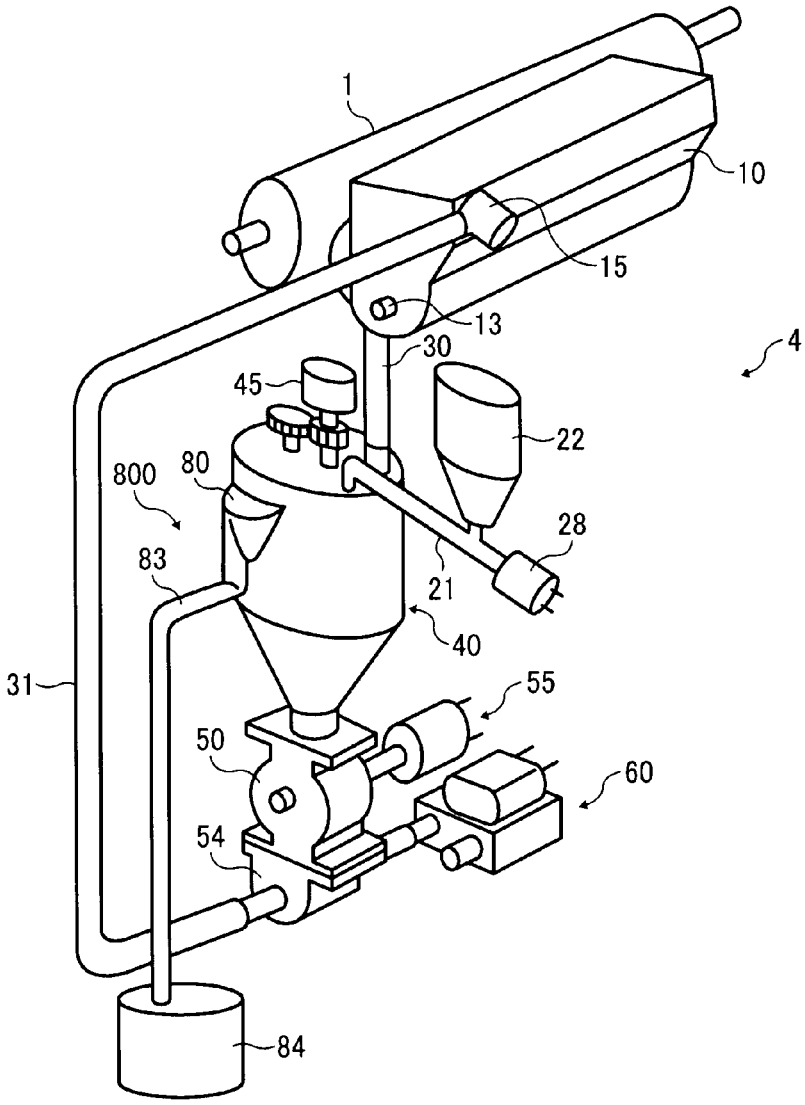
FIG. 2 is a schematic diagram illustrating a development device included in the image forming apparatus shown in FIG. 1.

FIG. 2 illustrates the development device 4 according to the present embodiment. The development device 4 shown in FIG. 2 includes the development portion (developing tank) 10 and the developer agitation unit 40.

The development portion 10 executes development process on the photoreceptor drums 1 and has a development roller 11 (shown in FIG. 3), serving as a developer bearer, to bear dry-type two-component developer in which carrier particles and toner particles are mixed. The development roller 11 is disposed facing the photoreceptor drum 1. The developer agitation unit 40 is provided beneath the development portion 10. In FIG. 2, the development device 4 further includes the supplemental developer hopper 22, and a developer circulation system. The circulation system includes a developer flow path and a developer transport mechanism. In the present embodiment, the developer flow path is constituted by a developer collection tube 30, which directly connects a lower portion of the development portion 10 with an upper portion of the developer agitation unit 40, and the developer is moved through the developer collection tube 30 by gravity. The developer is moved from a lower portion of the developer agitation unit 40 to an upper portion of the development portion 10 by the developer transport mechanism using airflow delivered by a pneumatic device. The developer transport mechanism includes a rotary feeder 50, a discharge portion 54, an air pump 60, an air supply tube 61, and a developer transport tube 31. The rotary feeder 50, functioning as a developer supply device (developer feeder), is continuous with and is located beneath the developer agitation unit 40 and supplies proper amount of the developer to the discharge portion 54. The discharge portion 54 discharges the developer supplied from the rotary feeder 50 to the developer transport tube 31 by the airflow. The air pump 60, functioning as the pneumatic device, supply air to the discharge portion 54 through the air supply tube 61 that is a path communicated between the air pump 60 and discharge portion 54. The developer discharged from the discharge portion 54 is transported to the development portion 10 through the developer transport tube 31 by the airflow from the air pump 60.

The supplemental developer hopper 22, serving as a developer replenishing device, that contains the supplemental developer is connected to the developer agitation unit 40 through a supplemental-developer tube 21. In addition, the developer agitation unit 40 further includes a developer escape chamber 80 as a developer discharge mechanism. The developer escape chamber 80 is connected to a waste developer container 84 through a developer discharging tube 83.

Figure 3:
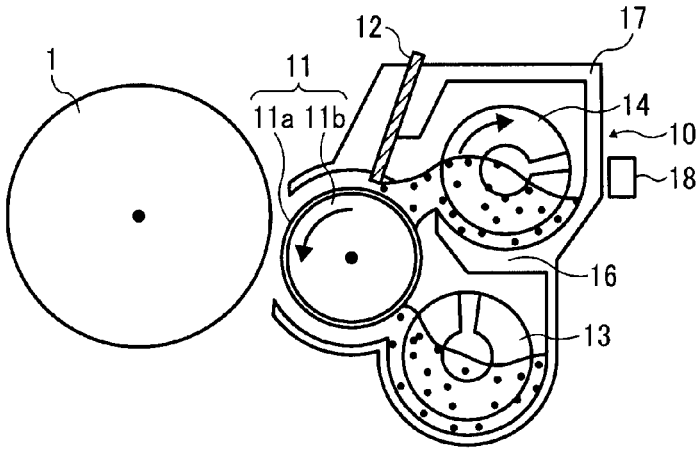
FIG. 3 shows a development portion of the development device shown in FIG. 2.

The interior structure of the development portion 10 is shown in FIG. 3. As shown in FIG. 3, in the development portion 10, the development roller 11, a doctor blade 12, a supply screw 14, and a collection screw 13 are surrounded by a casing 17. The development roller 11 carries the developer and is disposed facing the photoreceptor drum 1. The doctor blade 12 adjusts the amount of the developer carried on the development roller 11. The supply screw 14 supplies the developer while agitating and conveying the developer. The collection screw 13 collects used developer from the development roller 11, while agitating and conveying the developer. The supply screw 14 and the collection screw 13 are offset from the developing roller 11 so that they are located respectively higher than and lower than the developing roller 11, separated by a partition 16. A toner concentration detector 18 that detects toner concentration of the developer that is transported by the supply screw 14 is provided near the supply screw 14.

The development roller 11 includes an external non-magnetic cylindrical development sleeve 11*a* and an internal magnetic field generator 11*b* constituted by a magnet roller on which multiple magnets are provided to form multiple magnetic poles. The development sleeve 11*a* of the development roller 11 is rotatable around the fixed (non-rotatable) magnetic field generator 11*b*. The development roller 11 magnetically attracts and carries the developer supplied from the supply screw 14 while the development sleeve 11*a* is rotated. Then, the doctor blade 12 smoothes the amount of the developer magnetically attracted by the development sleeve 11*a* to be a uniform thickness (height). When the surface of the photoreceptor drum 1 contacts the developer where the photoreceptor drum 1 faces the development sleeve 11*a*, an electrostatic latent image on the photoreceptor drum 1 is developed with the toner into the toner image thereon.

In the development portion 10, the developer is supplied from the developer transport tube 31 through a developer inlet 15 positioned front side of paper on which FIG. 3 is drawn. While the supply screw 14 transports the developer from a front side to a backside, the developer is magnetically attracted by the development sleeve 11*a*. Then, the attracted developer is smoothed by the doctor blade 12 to a uniform thickness. The developer that is not supplied to the development roller 11 and is conveyed to the back end is dropped through an opening formed in a backside end of the partition 16 and is supplied to the collection screw 13. The collection screw 13 collects the used developer from the development roller 11 while agitating and conveying the developer from the backside to the front side. Thus, the developer is circulated and is agitated in the development portion 10 while the developer is supplied to and collected from the development roller 11.

The toner concentration of the developer collected by the collection screw 13 is decreased by consuming the toner in the development process. The developer that is conveyed to the front end by the collection screw 13 and that has a decreased toner concentration is dropped from a developer outlet formed in a bottom of the casing 17 to the developer agitation unit 40 through the developer collection tube 30.

Figure 4:
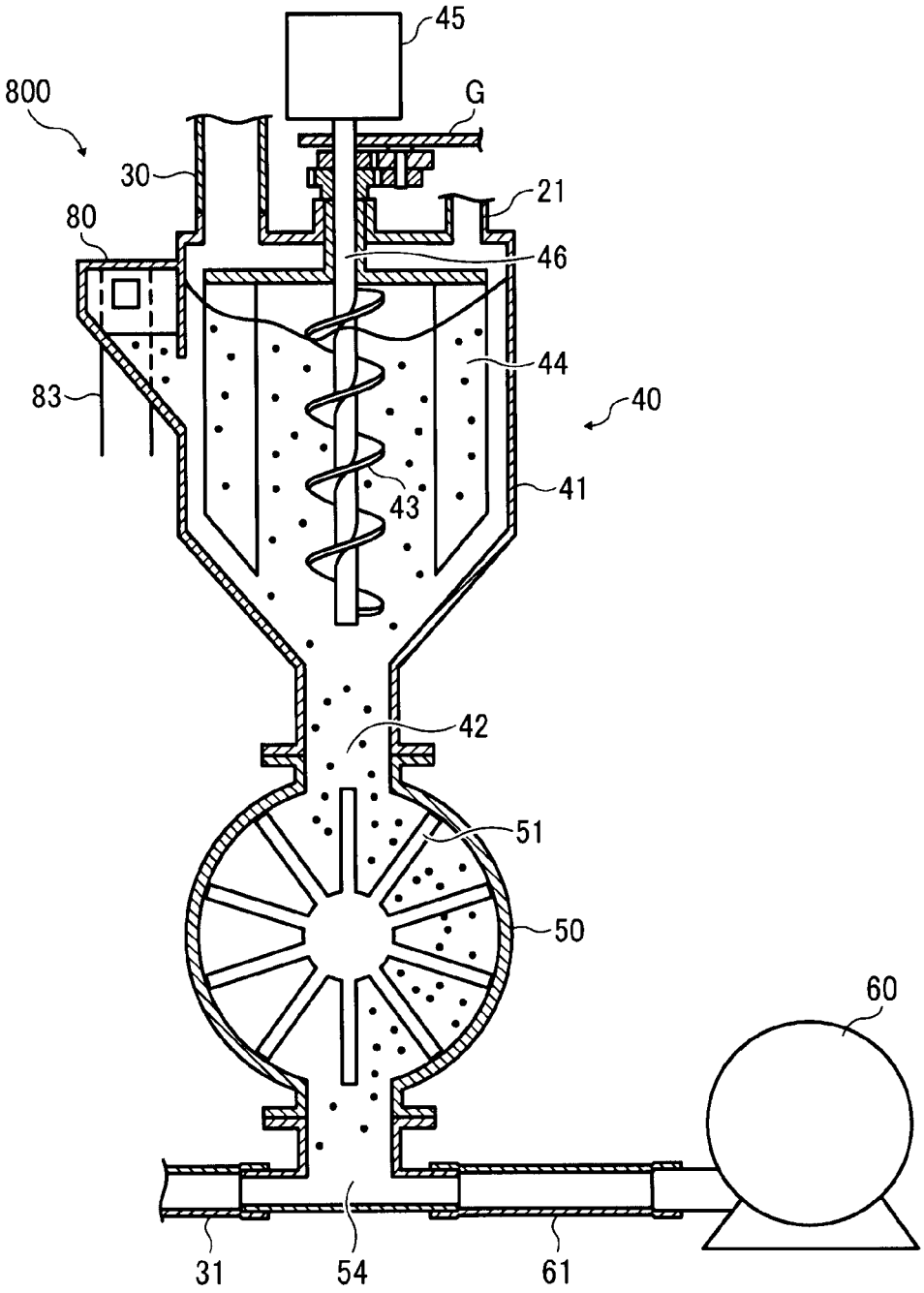
FIG. 4 is a cross-sectional diagram illustrating a developer agitation portion and a circulation system in the development device shown in FIG. 2.

Next, a configuration and operation of the developer agitation unit 40 of the development device 4 used in the above-described image forming apparatus 100 is described below, with reference to FIG. 4. FIG. 4 illustrates an internal structure of the developer agitation unit 40, the rotary feeder 50, and the air pump 51. As shown in FIG. 4, the developer agitation unit 40 has the agitation container 41 that is shaped like an upright cylinder, a lower end of which forms a funnel (upside-down cone), that is, a tapered portion of downwardly decreasing diameter. An agitation mechanism that has a screw agitator 43 and a blade agitator 44 is provided inside the agitation container 41. In FIG. 4, the screw agitator 43 extends vertically from a horizontal center portion of the upper surface of the agitation container 41 of the developer agitation unit 40, and the blade agitator 44 is located outside of the screw agitator 43. A driving motor 45 drives the screw agitator 43 and the blade agitator 44. The screw agitator 43 extends coaxially along a rotary shaft 46 of the driving motor 45 that extends in an axis direction that is a vertical direction. The blade agitator 44 is softly connected to the rotary shaft 46 so that the blade agitator 44 can be rotated around the rotary shaft 46. When the driving motor 45 rotates, the screw agitator 43 is rotated, and the blade agitator 44 is rotated via a driving gear group G in a direction opposite to a direction in which the screw agitator 43 is rotated. The screw agitator 43 is rotated in a center portion of the agitation container 41 to lift the developer from bottom to top in the agitation container 41. The blade agitator 44 is rotated around the screw agitator 43 along an inner circumferential face of the cylindrical agitation container 41.

As shown in FIG. 4, the developer collection tube 30 through which the developer is conveyed from the development portion 10 and the supplemental-developer tube 21 through which the supplemental developer is supplied from the supplemental developer hopper 22 are connected to the top of the agitation container 41 of the developer agitation unit 40. The developer whose toner concentration is decreased by the development process is transported to the agitation container 41 through the developer collection tube 30. Meanwhile, the supplemental developer hopper 22 contains supplemental premix developer in which the magnetic carrier is 5% through 10% mixed with the supplemental developer. When the toner concentration detector 18 in the development portion 10 detects the shortage of the toner concentration, the supplemental premix developer in the supplemental developer hopper 22 is supplied to the agitation container 41 by driving a screw as a conveying member is driven by a supplemental developer motor 28 (see FIG. 2). The supplemental amount of the developer provided through the supplemental-developer tube 21 is determined by the detection result obtained by the toner concentration detector 18.

Referring back to FIG. 2, the agitation container 41 of the developer agitation unit 40 is replenished with premix developer from the supplemental developer hopper 22 through the supplemental-developer tube 21 as appropriate as the toner is consumed. The used developer from the development portion 10 through the developer collection tube 30 is agitated and mixed with the premix developer, the toner is dispersed in the agitation container 41 and then the toner is charged. More specifically, the used developer is agitated with the supplied premix developer by rotating the blade agitator 44, and the developer is lifted from bottom to top. Therefore, the developer is sterically agitated by generating convection in the agitation container 41. Thus, the used developer transported from the collection screw 13 in the development portion 10 is agitated and mixed with the toner and the magnetic carrier in the supplemental premix developer supplied from the supplemental developer hopper 22, and the developer in the agitation container 41 is adjusted to the preferable toner concentration and the charging amount. The developer after agitation is conveyed to the rotary feeder 50 through a discharge spout 42 formed in a bottom of the agitation container 41.

Beneath the developer agitation unit 40, the rotary feeder 50 to supply the developer from the developer agitation unit 40 to the developer transport tube 31, is provided. The rotary feeder 50 is continuous with the developer agitation unit 40, and the developer agitated in the developer agitation unit 40 is supplied to the rotary feeder 50. In addition, the rotary feeder 50 includes a rotary impeller 51 that has a rotary shaft and multiple blades around the rotary shaft (see FIG. 4). The developer feeder 50 can discharge the constant amount of the developer from the developer agitation unit 40 to the developer transport tube 31 while adjusting the amount of the developer by rotating the rotary impeller 51 driven by a rotary-feeder driving motor 55 (see FIG. 2).

The discharge portion 54 is provided beneath the rotary impeller 51. The discharge portion 54 is connected to the air supply tube 61 and the developer transport tube 31. The air supply tube 61 connects the air pump 60 and the discharge portion 54. The air pump 60 generates air to move the developer from the rotary feeder 50 to the developer transport tube 31. In the discharge portion 54, the developer from the rotary feeder 50 is mixed with the air from the air pump 60 through the air supply tube 61. The constant amount of the developer discharged by the rotary impeller 51 is transported to the developer transport tube 31 via the discharge portion 54 by blowing air supplied from the air pump 60. Then, the mixed developer in the developer transport tube 31 is transported to the developer inlet 15 in the development portion 10. The developer from the developer inlet 15 is transported to the supply screw 14 and then is circulated in the development portion 10.

With this configuration, the developer is circulated between the developer agitation unit 40 and the development portion 10. The developer is transported from the development portion 10 to the developer agitation unit 40 through the developer collection tube 30 by gravity, it is not necessary to provide an air pump. On the other hand, the amount of the conveying developer is controlled and determined by the rotation velocity of the rotary feeder 50 and the flowing amount of the air pump 60. The amount of the transport developer is controlled so that the amount of the supplying developer to the development portion 10 to be constant. Therefore, in this configuration, even when the amount of the developer is increased in the development device 4, by supplying the supplemental premix developer, the amount of the developer in the development portion 10 is constant and the developer is increased in the agitation container 41; therefore, the increased amount of the surplus developer is discharged from the agitation container 41.

Feature of Development Device

In the present embodiment, the development device 4 includes the developer escape chamber 80 that projects from an upper portion of a sidewall 41S of the cylindrical agitation container 41 and a discharge opening 81 provided on a lateral wall 80W of the developer escape chamber 80. The developer escape chamber 80 and the discharge opening 81 function as a developer discharge mechanism 800 to discharge surplus developer caused by increasing the supplied premix developer.

Figure 5:
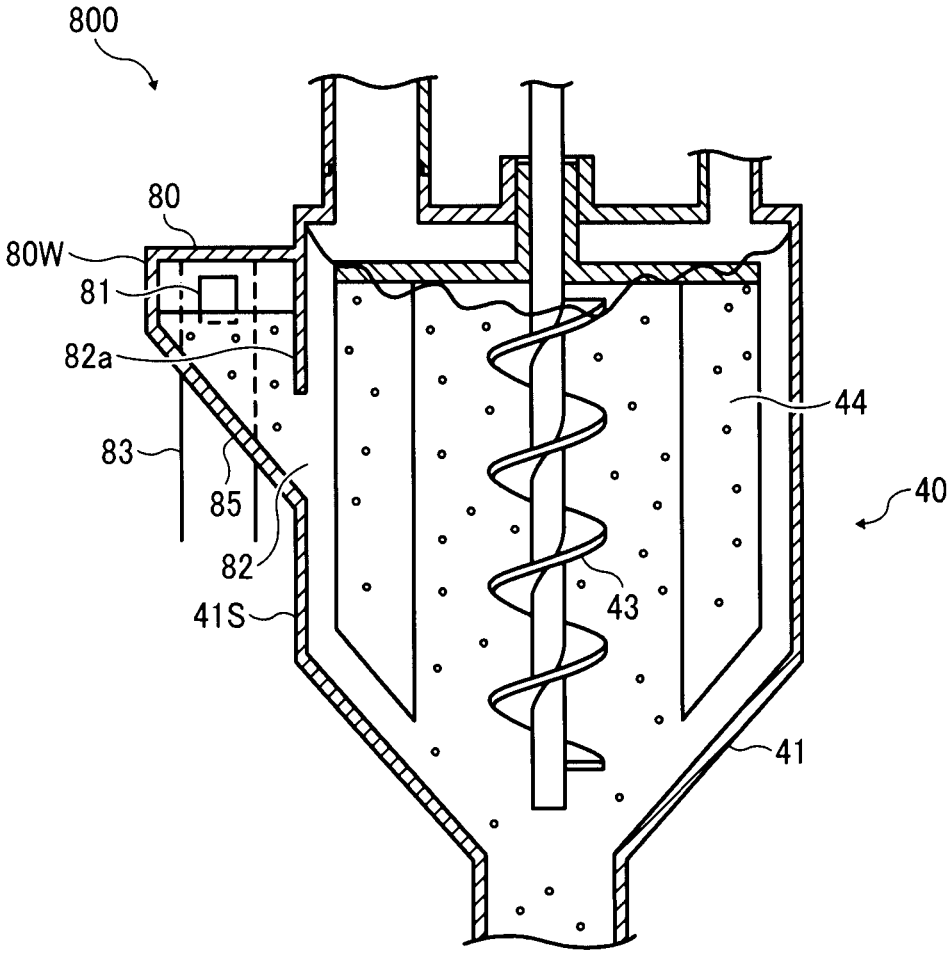
FIG. 5 is an expanded view of a developer discharge mechanism and the developer agitation portion shown in FIG. 4.

FIG. 5 is an expanded diagram illustrating the developer agitation unit 40 in which the developer discharge mechanism 800 is provided. The developer escape chamber 80 is disposed in communication with the agitation container 41 through a communicating pathway (space) 82 so that the developer in the agitation container 41 can enter the developer escape chamber 80. In addition, the discharge opening 81 formed on the lateral wall 81W of the developer escape chamber 80 is provided so that a lower end of the discharge opening 81 is positioned higher than the communicating pathway 82. The discharge opening 81 is connected to the developer discharging tube 83. That is, the developer escape chamber 80 projects from and continuous with the agitation container 41 to discharge surplus developer in the agitation container 41. The developer escape chamber 80 defines the communication pathway 82 in a side of the agitation container 41 between the agitation container 41 and the developer escape chamber 80 through which the developer is moved between the agitation container 41 and the developer escape chamber 80. The developer escape chamber 80 has the discharge opening 81 whose lower end is positioned higher than the communication pathway 82.

In the agitation container 41, a level (top surface of the powder) of the developer is up and down moved by agitating the developer by the screw agitator 43 and the blade agitator 44. Further, due to rotation of the blade agitator 44, flow of the developer is formed in the circumferential direction in the cylindrical agitation container 41. However, providing the developer escape chamber 80 to project outward from the sidewall 41S of the cylindrical agitation container 41, the developer is pushed out from the agitation container 41 and then is remained in the developer escape chamber 80. The developer escape chamber 80 is provided outside of an agitating region in the agitation container 41. Therefore, even when the screw agitator 43 and the blade agitator 44 are operated, the fluctuation in the level of the developer in the developer escape chamber 80 caused by the agitation is eliminated. In addition, the discharge opening 81 provided in the lateral wall 80W of the developer escape chamber 80 is positioned above the communicating pathway 82, so an upper sidewall 82*a* positioned above the communicating pathway 82 functions as a partition between the agitation container 41 and the developer escape chamber 80. That is, the upper sidewall 82*a* causes the level of the developer near the discharge opening 81 in the developer escape chamber 80 to be stabilized, without being effected from the fluctuation in the level of the developer caused by the agitation in the agitation container 41 and the flow of the developer caused by the rotation of the blade agitator 44. With this configuration, the level of the developer in the developer escape chamber 80 is increased as the amount of the developer in the agitation container 41 is increased, and the developer starts to be discharged when the level of the developer reaches the height of the discharge opening 81. The developer discharged from the discharge opening 81 is discharged to the waste developer tank 84 through the developer discharging tube 83, using a transport member such as screw in the developer discharging tube 83.

Thus, the developer discharge mechanism 800 in the development device 4 can avoid the effect of the agitation while the developer is agitated in the agitation container 41 and can discharge the surplus developer stably, because the level of the developer in the agitation container 41 is stably adjusted with respect to the increase or decrease in the amount of the developer in the agitation container 41. With this configuration, the development device 4 that circulates the developer between the development portion 10 and the developer agitation unit 40 can prevent the deterioration of the carrier of the developer in the development device 4 by discharging the surplus developer from the developer device 4 while the development device 4 is replenished with the developer. The height of the discharge opening 81 formed in the developer escape chamber 80 is dimensioned so that the developer in the developer escape chamber 80 is discharged when the level of the developer reaches a specified height to be discharged.

In addition, as illustrated in FIG. 5, a sloped surface 85 that connects the sidewall 41S of the agitation container 41 and the lateral wall 80W of the developer escape chamber 80 may be formed on a lower portion of the developer escape chamber 80. The communicating pathway 82 is surrounded by the sloped surface 85, a lower tip of the upper sidewall 82*a*, and an upper tip of the sidewall 41S. Provided with the sloped surface 85, when the agitation in the agitation container 41 is stopped, the developer in the developer escape chamber 80 slides down the sloped surface 85 and then returns to the agitation container 41, which can prevent from the developer from remaining in the developer escape chamber 80.

Figure 6:
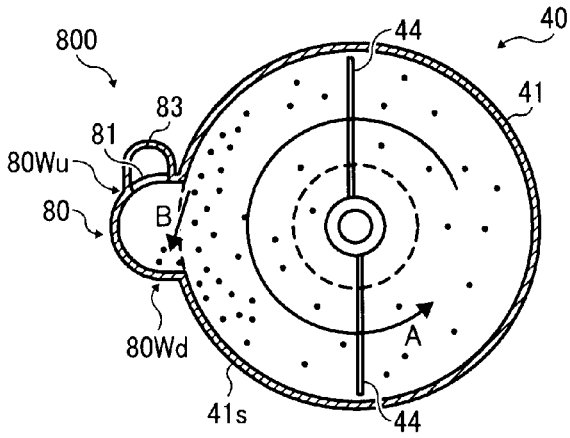
FIG. 6 is an end-on, axial, cross-sectional diagram illustrating the developer agitation portion and the developer discharge mechanism including a screw agitator, viewed along a shaft of the screw agitator.

FIG. 6 is a cross-sectional diagram illustrating the developer agitation unit 40 and the developer discharge mechanism 800, viewed from above. As illustrated in FIG. 6, the flow of the developer is formed in the circumferential direction of the agitation container 41 indicated by arrow A by the rotation of the blade agitator 44, and the developer is likely to be popped out toward downstream side of the rotation of the blade agitator 44 in a direction indicated by arrow B by centrifugal force of the rotation. While the blade agitator 44 is rotated, the level of the developer in the agitation container 41 is shaped like a mortar, and the level of the developer positioned outside of the agitation container 41 is lifted (pumped up). In a state in which the developer in the agitation container 41 is a moderate amount or less and the developer is not accumulated in the developer escape chamber 80, the developer is popped into a downstream portion of the developer escape chamber 80 in which the blade agitator 44 is rotated, because the developer is popped out from the agitation container 41 in the direction indicated by arrow B. If the discharge opening 81 is formed in a downstream wall 80Wd of the developer escape chamber 80, the developer thus popped in may be directly discharged from the discharge opening 81 inadvertently (mistakenly). In order to solve this situation, in the present embodiment, the discharge opening 81 is formed in an upstream wall 80Wu of the developer escape chamber 80 in the direction in which the blade agitator 44 is rotated. With this configuration, the mistaken discharge caused by popping the developer into the developer escape chamber 80 when the developer in the agitation container 41 is the moderate amount or less can be prevented.

Figure 7A:
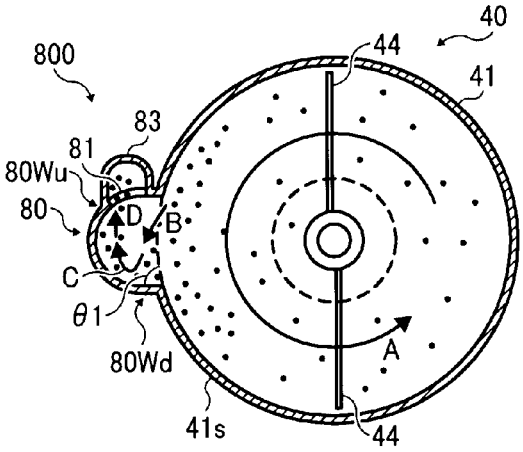
FIG. 7A is an end-on, axial, cross-sectional diagram illustrating a flow of developer in the developer agitation portion and the developer discharge mechanism shown in FIG. 5, viewed along the shaft of the screw agitator.
Figure 7B:
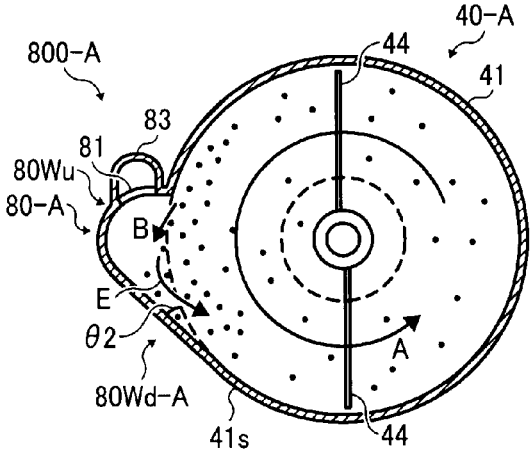
FIG. 7B is an end-on, axial, cross-sectional diagram illustrating the developer agitation portion and a developer discharge mechanism according to a variation of the present embodiment, viewed along the shaft of the screw agitator.

FIGS. 7A and 7B are cross-sectional diagrams illustrating the agitation container 43 and the developer discharge mechanism 800. As described above, the developer is popped into the downstream portion of the developer escape chamber 80 because the developer is popped out from the agitation container 41 in the direction indicated by arrow B by centrifugal force from the rotation of the blade agitator 44. With this popping movement, the developer may hit to the downstream wall 80Wd in which the blade agitator 44 is rotated. At this time, as illustrated in FIG. 7A, in a configuration in which an angle θ1 between the downstream wall 80Wd of the developer escape chamber 80 and the sidewall 41S of the agitation container 41 is large (such as right angle or obtuse angle), the developer that hits the downstream wall 80Wd may easily bounce back in a direction indicated by arrow D, and then the developer may be inadvertently popped into the discharge opening 81 formed in the upstream wall 80Wu of the developer escape chamber 80 and may be mistakenly discharged from the discharge opening 81.

Accordingly, to achieve better developer movement in configuration, as a variation developer agitation unit 40-A shown in FIG. 7B, an angle θ2 between a downstream wall 80Wd-A of a developer escape chamber 80-A and the sidewall 41S of the agitation container 41 is sharp (acute angle). With this configuration, the developer easily slides down the downstream wall 80Wd-A and returns to the agitation container 41 in a direction indicated by arrow E, and the mistaken discharge caused by bounce back to the downstream wall 80Wd-A can be eliminated.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a development portion, to develop a latent image formed on a latent image carrier with developer including toner and carrier particles;

a developer agitation container to contain the developer, positioned separately from the development portion;

a circulation system through which the developer is circulated between the development portion and the developer agitation container;

a developer replenishing device to supply fresh developer to the developer agitation container;

an agitator, provided inside the developer agitation container, to agitate and mix the collected developer collected from the development portion through the circulation system and the fresh developer from the developer replenishing device; and a developer escape chamber to discharge surplus developer in the developer agitation container, projecting from and continuous with the developer agitation container, the developer escape chamber defining a communication pathway in a side of the developer agitation container between the developer agitation container and the developer escape chamber through which the developer is moved between the developer agitation container and the developer escape chamber, and the developer escape chamber having a discharge opening whose lower end is positioned higher than the communication pathway.

2. The development device according to claim 1, wherein the developer agitation container is a cylindrical container, and the agitator comprises a blade agitator that is rotatable in a circumferential direction within the developer agitation container.

3. The development device according to claim 2, wherein the discharge opening is formed in an upstream lateral wall of the developer escape chamber in a direction in which the blade agitator is rotated.

4. The development device according to claim 3, wherein an angle between a sidewall of the developer agitation container and a downstream lateral wall of the developer escape chamber in the direction in which the blade agitator is rotated is an acute angle.

5. The development device according to claim 1, wherein the bottom of the developer escape chamber is a sloped surface inclined from a sidewall of the developer container to a lateral wall of the developer escape chamber.

6. An image forming apparatus comprising:

a latent image carrier to carry a latent image; and a development device comprising:

a development portion, to develop a latent image formed on a latent image carrier with developer including toner and carrier particles;

a developer agitation container to contain the developer, positioned separately from the development portion;

a circulation system through which the developer is circulated between the development portion and the developer agitation container;

a developer replenishing device to supply fresh developer to the developer agitation container;

an agitator, provided inside the developer agitation container, to agitate and mix the collected developer collected from the development portion through the circulation system and the fresh developer from the developer replenishing device; and a developer escape chamber to discharge surplus developer in the developer agitation container, projecting from and continuous with the developer agitation container, the developer escape chamber defining a communication pathway in a side of the developer agitation container between the developer agitation container and the developer escape chamber through which the developer is moved between the developer agitation container and the developer escape chamber, and the developer escape chamber having a discharge opening whose lower end is positioned higher than the communication pathway.

* * * * *